US007896164B2

(12) United States Patent
Schmid et al.

(10) Patent No.: US 7,896,164 B2
(45) Date of Patent: Mar. 1, 2011

(54) DEVICE FOR SORTING OUT WASTE PARTS OF WORKPIECES PROCESSED ON SAWS, PREFERABLY ON OPTIMIZING CROSS-CUT SAWS, AND METHOD USING SUCH DEVICES

(75) Inventors: Thomas Schmid, Langenau (DE); Georg Reinbold, Maselheim (DE)

(73) Assignee: GreCon Dimter Holzoptimierung Süd GmbH & Co. KG, Illertissen (DE)

( * ) Notice: Subject to any disclaimer, the term of this patent is extended or adjusted under 35 U.S.C. 154(b) by 443 days.

(21) Appl. No.: 11/840,250

(22) Filed: Aug. 17, 2007

(65) Prior Publication Data

US 2008/0041771 A1 Feb. 21, 2008

(30) Foreign Application Priority Data

Aug. 17, 2006 (DE) ..... 10 2006 039 702

(51) Int. Cl.
*B07C 5/14* (2006.01)
*B26D 7/06* (2006.01)

(52) U.S. Cl. ..... 209/517; 209/521; 209/698; 209/618; 83/157; 83/110

(58) Field of Classification Search ..... 209/698, 209/514, 521, 617, 618, 651, 653, 657; 83/155, 83/157, 110
See application file for complete search history.

(56) References Cited

U.S. PATENT DOCUMENTS

| | | | | | |
|---|---|---|---|---|---|
| 3,990,335 | A * | 11/1976 | Morse et al. | 83/155 |
| 4,085,638 | A | 4/1978 | Fifer | |
| 4,462,287 | A * | 7/1984 | Weis et al. | 83/104 |
| 4,699,031 | A * | 10/1987 | D'Angelo et al. | 83/23 |
| 4,860,619 | A * | 8/1989 | Yunoki | 83/80 |
| 5,156,077 | A * | 10/1992 | Stursberg | 83/369 |
| 5,181,445 | A * | 1/1993 | Cothrell | 83/155 |
| 5,379,668 | A * | 1/1995 | Standing | 83/99 |
| 5,475,917 | A * | 12/1995 | Biagiotti | 29/822 |
| 6,283,353 | B1 | 9/2001 | Gilbert | |
| 6,607,082 | B2 * | 8/2003 | Biagioni et al. | 209/620 |
| 7,080,738 | B2 * | 7/2006 | Gambini | 209/620 |
| 7,571,801 | B2 * | 8/2009 | Bavelloni | 198/817 |
| 7,631,748 | B2 * | 12/2009 | Mitchell | 198/463.1 |

FOREIGN PATENT DOCUMENTS

| | | | |
|---|---|---|---|
| CN | 2902629 | Y * | 5/2007 |
| DE | 8408807 | A1 | 6/1984 |
| DE | 3511272 | A1 | 10/1986 |
| DE | 4317443 | A1 | 11/1994 |

* cited by examiner

*Primary Examiner* — Stefanos Karmis
*Assistant Examiner* — Luis Gonzalez
(74) *Attorney, Agent, or Firm* — Gudrun E. Huckett

(57) ABSTRACT

A device for sorting out waste parts of workpieces on saws has a saw having at least one saw blade for cutting workpieces into workpiece parts. At least one feed roller is arranged upstream of the saw in a transport direction of workpieces. At least one feed roller is arranged downstream of the saw in the transport direction. At least one transport device is provided for the workpiece parts cut at the saw. At least one acceleration roller is arranged in the transport direction of the workpieces downstream of the saw so that the cut workpiece parts are transported by being accelerated away from the cutting area.

11 Claims, 5 Drawing Sheets

DEVICE FOR SORTING OUT WASTE PARTS OF WORKPIECES PROCESSED ON SAWS, PREFERABLY ON OPTIMIZING CROSS-CUT SAWS, AND METHOD USING SUCH DEVICES

BACKGROUND OF THE INVENTION

The invention relates to a device for sorting out waste parts of workpieces on saws, preferably, on optimizing cross-cut saws. The device comprises at least one saw blade having arranged downstream and upstream thereof at least one feed roller and comprising at least one transporting device for the sawed workpiece parts downstream of the saw. The invention also relates to a method for sorting out waste parts of workpieces on saws by employing the device of the aforementioned kind.

It is known to mark flaws on wooden workpieces and, based on these marks, to cut the flawed pieces by means of the saw from the wooden workpiece. The waste parts are sorted out while the good parts are transported away and then sorted.

SUMMARY OF THE INVENTION

It is an object of the present invention to configure the device of the aforementioned kind and the method of the aforementioned kind in such a way that sorting out waste parts can be carried out at high output and great precision.

In accordance with the present invention, this is achieved in connection with the device in that in the transport direction of the workpieces behind the saw at least one acceleration roller for the sawed workpiece parts is provided. In accordance with the present invention, this is achieved in connection with the method in that the sawed workpiece parts are transported away from the saw area in an accelerated fashion.

The workpiece parts that are cut off by the saw are transported with acceleration away from the saw area by means of the acceleration roller so that sequential cut-off workpiece parts can be transported quickly one after another through the device. The acceleration action ensures that the workpiece parts are transported away in a reliable fashion.

DESCRIPTION OF THE PREFERRED EMBODIMENTS

Figure 1:
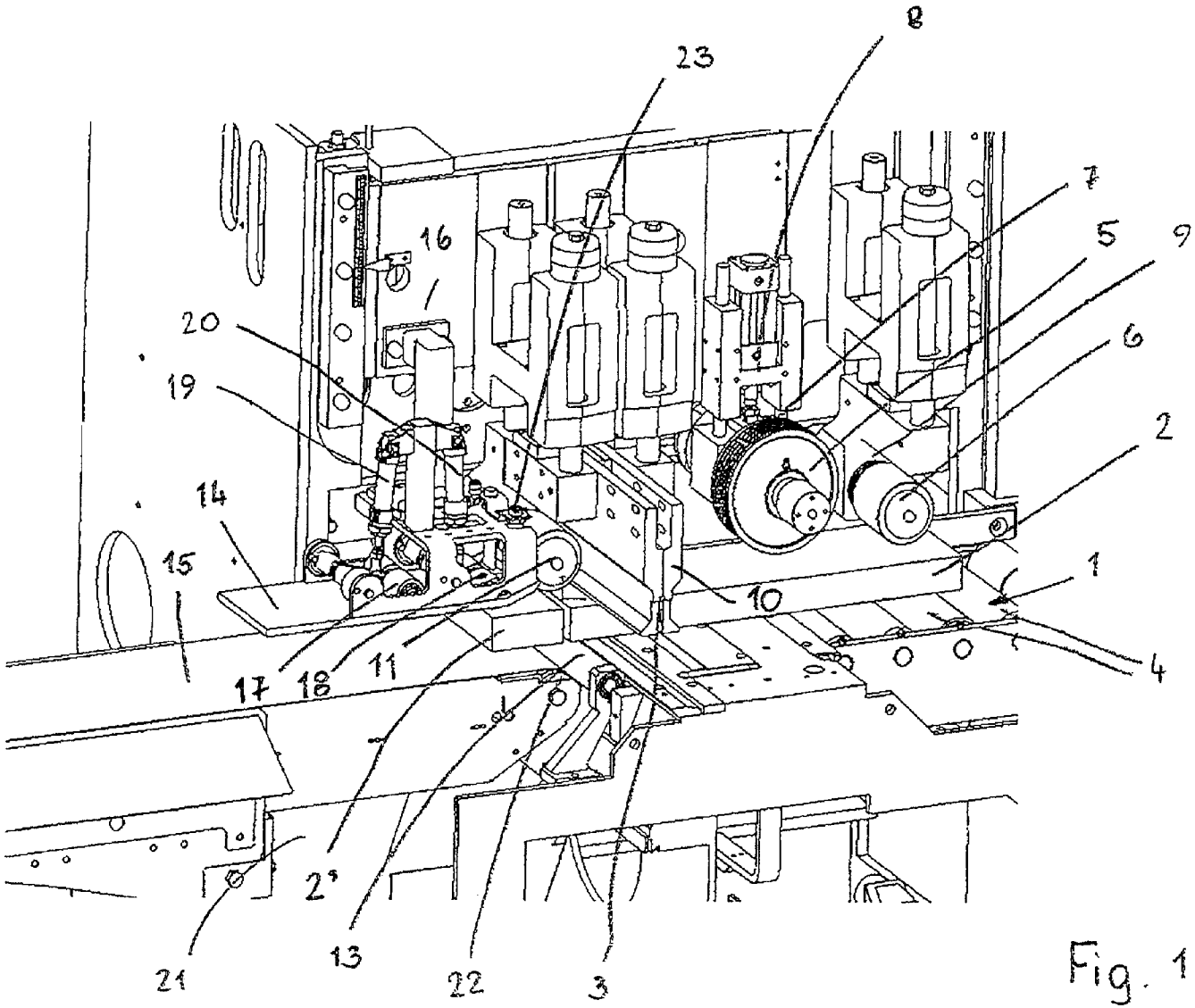
FIG. 1 is a perspective illustration of a device according to the invention.

The device has a transport path 1 on which workpieces to be sawed are transported to a saw 3. The transport path 1 is comprised of adjacently positioned transport rollers 4 that are freely rotatable about horizontal axles. Above the transport path 1 there are feed rollers 6, 11, 12 that are preferably height-adjustable so that they can be adjusted relative to workpieces 2 having different thickness. The feed roller 6 has arranged downstream thereof a measuring wheel 5 that is rotatable about a horizontal axle in the same way as the feed rollers 6, 11, 12. The measuring wheel 5 has a larger diameter than the feed roller 6 and is not driven. The feed rollers 6, 11, 12 are driven in rotation by a drive 9, respectively. The drives 9 can be actuated independent of one another. The feed rollers 6, 11, 12 are adjusted such that they rest on the workpiece 2 so that the workpiece is reliably supplied on the transport path 1 to the saw 3.

The saw 3 has a saw blade (not illustrated) that, in the illustrated embodiment, is moved from below the workpiece upwardly during the sawing process. The saw blade is moved into housing 10 below which the workpieces 2 passes through.

The saw 3 is provided upstream and downstream of the saw blade with a feed roller 11, 12, respectively. The feed rollers 11, 12 are rotatably driven about parallel horizontal axles. Both feed rollers 11, 12 have advantageously the same diameter and, like the feed roller 6, can be adjusted advantageously to the thickness of the workpieces 2. Below the feed rollers 11, 12 there are additional transport rollers 13 on which the workpieces 2 can be reliably transported.

It is also possible to drive the table rollers or transport rollers and to use the top rollers 6, 11, 12 only as pressure rollers. It is also possible to rotatably drive the top rollers 6, 11, 12 as well as the bottom rollers 13.

In the transport direction of the workpieces 2 behind the saw 3 there is at least one holding-down device 14 that holds down the sawed-off workpieces as they are transported by means of an endless circulating sorting belt 15. The end of the holding-down device 14 facing the saw 3 is configured to extend upwardly at a slant so that the sawed-off workpiece parts 2' are transported reliably into a position underneath the holding-down device 14. The holding-down device 14 is plate-shaped and can be height-adjusted transverse to the sorting belt 15. Also, it is possible to adjust the holding-down device 14 parallel to the sorting belt 15. In this way, the holding-down device 14 can be adjusted optimally to the workpiece parts 2' to be transported. The holding-down device 14 is provided on a support device 16 on which the drives for height adjustment and/or transverse adjustment of the holding-down device 14 are provided also.

In the illustrated embodiment, two sorting rollers 17, 18 are provided on the support device 16 and are independently height-adjustable. For this purpose, adjusting cylinders 19, 20 are provided on the support device 16 with which the sorting rollers 17, 18 can be adjusted by the desired amount. The sorting rollers 17, 18 project through openings in the holding-down device 14. By actuation of the adjusting cylinders 19, 20 the sorting rollers 17, 18 are moved downwardly until they contact the sawed-off workpiece part 2'.

The deflection rollers 22 for the sorting belt 15 positioned adjacent to the saw 3 can be adjusted in the transport direction of the workpieces 2. In the position illustrated in FIGS. 1 and 2, the waste part chute 21 is closed off by the sorting belt 15. As a result of the adjustability of the deflection rollers 22, the waste part chute 21 can be partially or completely opened so that in a way to be described in the following sawed-off waste parts can drop behind the saw 3 into the waste part chute 21. The adjustability of the deflection rollers 22 of the sorting belt 15 is known and is therefore not explained in detail in this connection.

The sorting belt 15 is driven continuously during operation of the sawing device. By means of the sorting belt 15 the sawed-off workpiece parts 2' are transported farther, in particular to a sorting device with which the workpiece parts 2' are sorted with regard to their length.

The workpiece parts 2 are marked before the sawing process with regard to flaws. This can be done manually, for example, by applying a chalk mark, or automatically by scanning devices. When the marked pieces enter the sawing device, the marks on the workpieces 2 are detected by a corresponding reading device and input into a control unit of the device. In this way, it is possible to cut a workpiece 2 detected in this way at the marks and to sort the good parts 2' by means of the sorting belt 15 and to sort out the waste parts 2' by opening the waste part chute 21. The corresponding adjustments are done automatically by means of the control unit.

Figure 2:
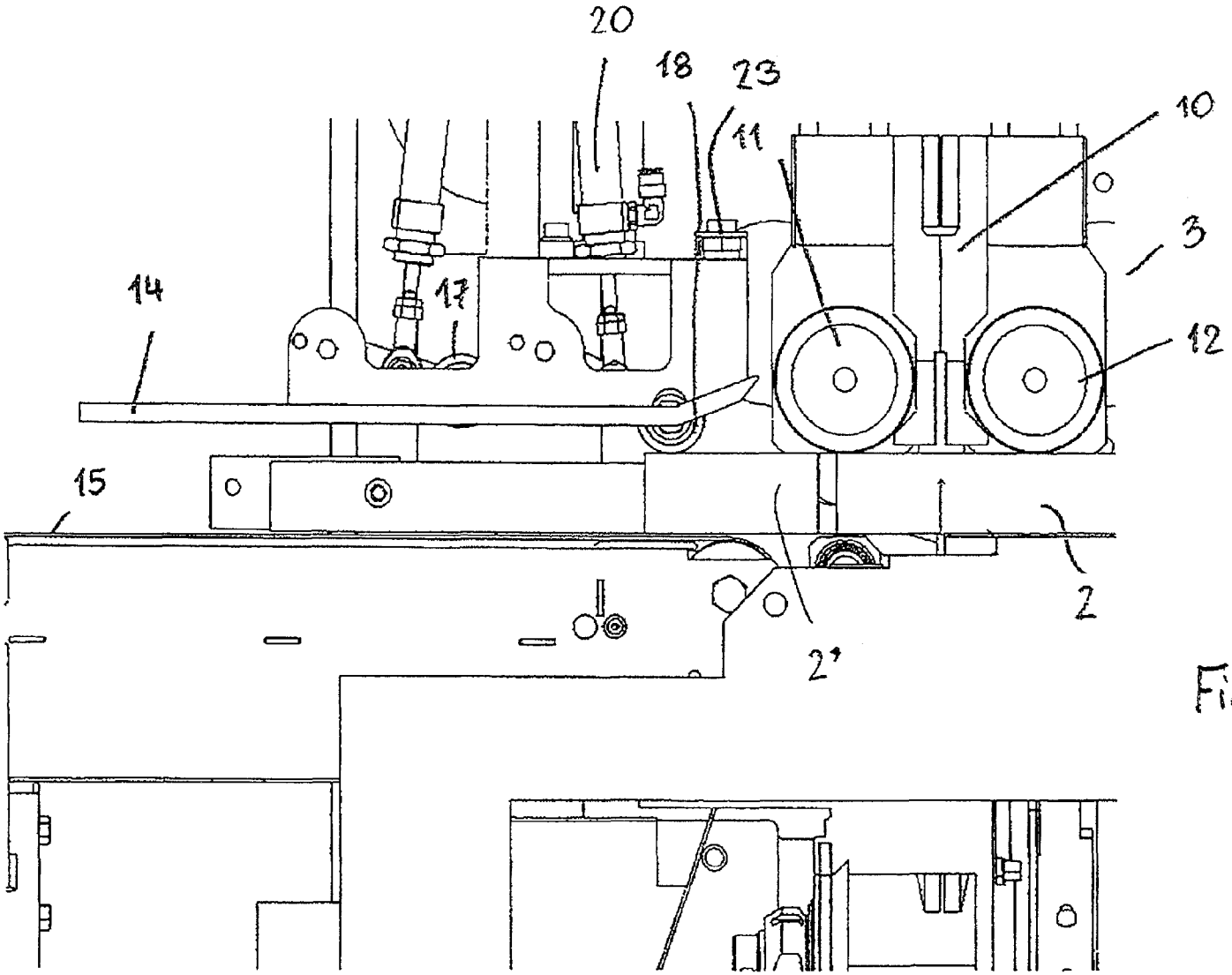
FIG. 2 is a device according to FIG. 1 in a front view showing the waste part chute in a completely closed position.

Based on FIG. 2 through FIG. 5, the method steps will be explained in an exemplary fashion. Upstream of the transport path 1 with the transport rollers 4, there is a transport device (not illustrated) that is comprised advantageously of an endless circulating transport belt on which the workpieces are supplied to the feed roller 6. The feed roller 6 engages the workpieces 2 and transports them to the saw 3 arranged downstream. The workpiece 2 is received by the feed rollers 11, 12 correlated with the saw 3 which rollers, driven in rotation, transport the workpiece 2 into the desired position in the cutting area of the saw 3. As soon as the marking or the cutting position of the workpiece 2 is located in the cutting area at the level of the saw blade, the drive action of the feed rollers 11, 12 is interrupted and, in this way, the workpiece 2 is positioned properly at the saw 3. Subsequently, the cut is carried out by the saw at the cutting position. As soon as the cut has been completed, the two feed rollers 11, 12 are driven again and the feed roller 11 transports the sawed-off workpiece part 2' into a position underneath the holding-down device 14. FIG. 2 shows a situation in which the sawed-off workpiece part 2' has only a minimal length. It is transported by the feed roller 11 away from the saw 3 to a position underneath the holding-down device 14. By a short actuation of the adjusting cylinder 20 the sorting roller 18 neighboring the feed roller 11 is moved downwardly and pressed against the workpiece part 2'. The workpiece part 2' is thus pressed against the sorting belt 15 and accelerated. The pressure acting on the workpiece part 2' is adjusted to be just so great that it is safely entrained by the continuously driven sorting belt 15. The acceleration of the sawed-off workpiece part 2' on the sorting belt 15 circulating continuously at constant speed can be, for example, up to 250 m/min. As a result of this targeted acceleration of the workpiece part 2', the time needed for entraining the workpiece part 2' on the sorting belt 15 does not depend on friction factors, such as weight of the parts, surface structure and the like.

Figure 3:
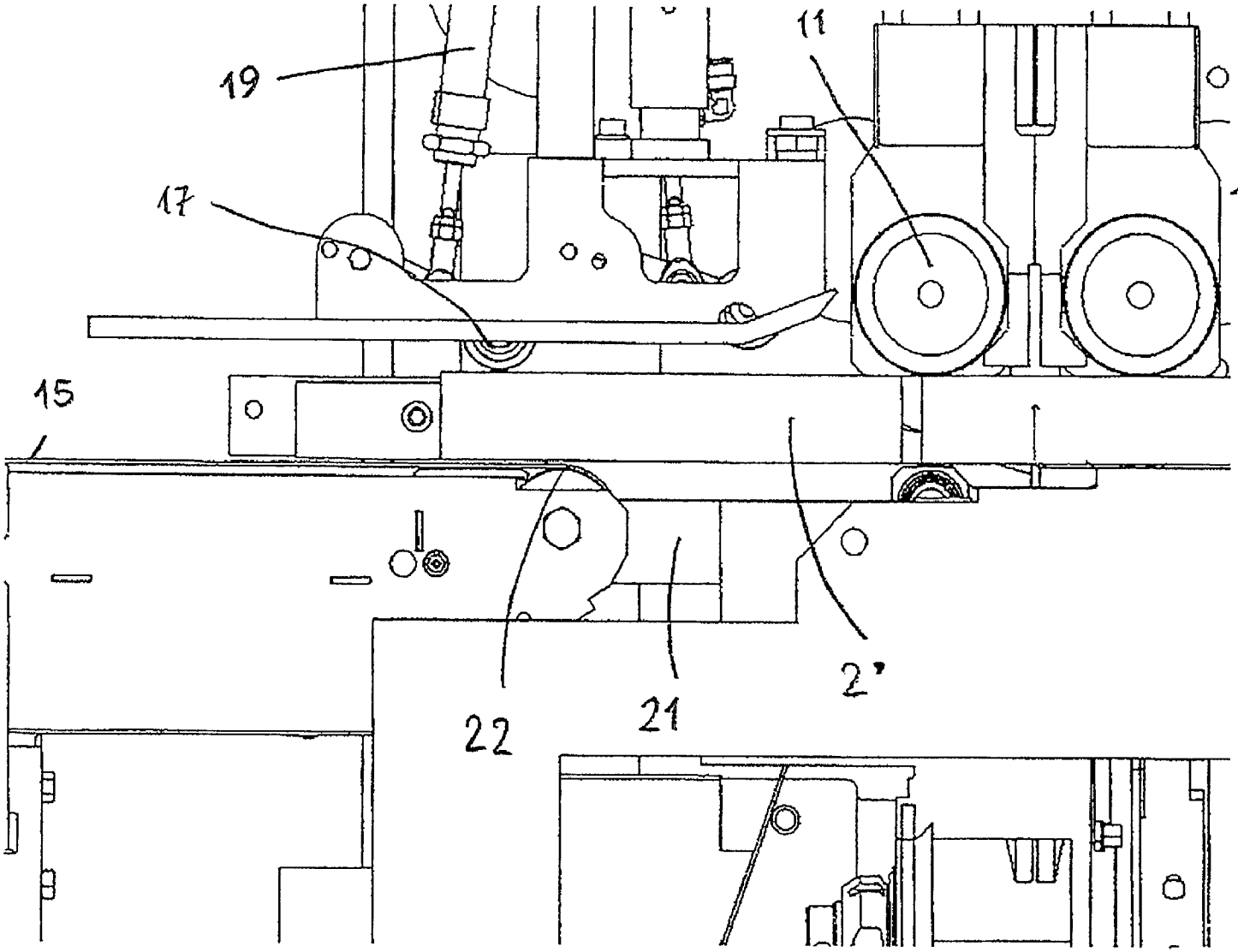
FIG. 3 is an illustration in accordance with FIG. 2 of the device according to the invention showing the waste part chute in a partially open position.

FIG. 3 shows a situation where the waste part chute 21 is partially open in that the appropriate deflection rollers 22 for the sorting belt 15 have been retracted. This movement of the deflection rollers 22 can be done already before the sawing process takes place because, before the workpiece 2 enters the sawing device, the cutting position where the cut is to be performed has already been read into the control unit. Based on these read-in data the corresponding adjustments of the machine parts can be realized. FIG. 3 shows that the sawed-off workpiece part 2' is longer than that in the embodiment according to FIG. 2. The workpiece part 2' is so long that, despite the waste part chute 21 being partially opened, it can reach the sorting belt 15 and does not drop into the open waste part chute 21. As a result of the greater length of the workpiece part 2', the sorting roller 17 remote from the feed roller 11 is pressed by means of the adjusting cylinder against the workpiece part 2' that is entrained by the sorting belt 15 and is accelerated in the described way in a targeted fashion.

Figure 4:
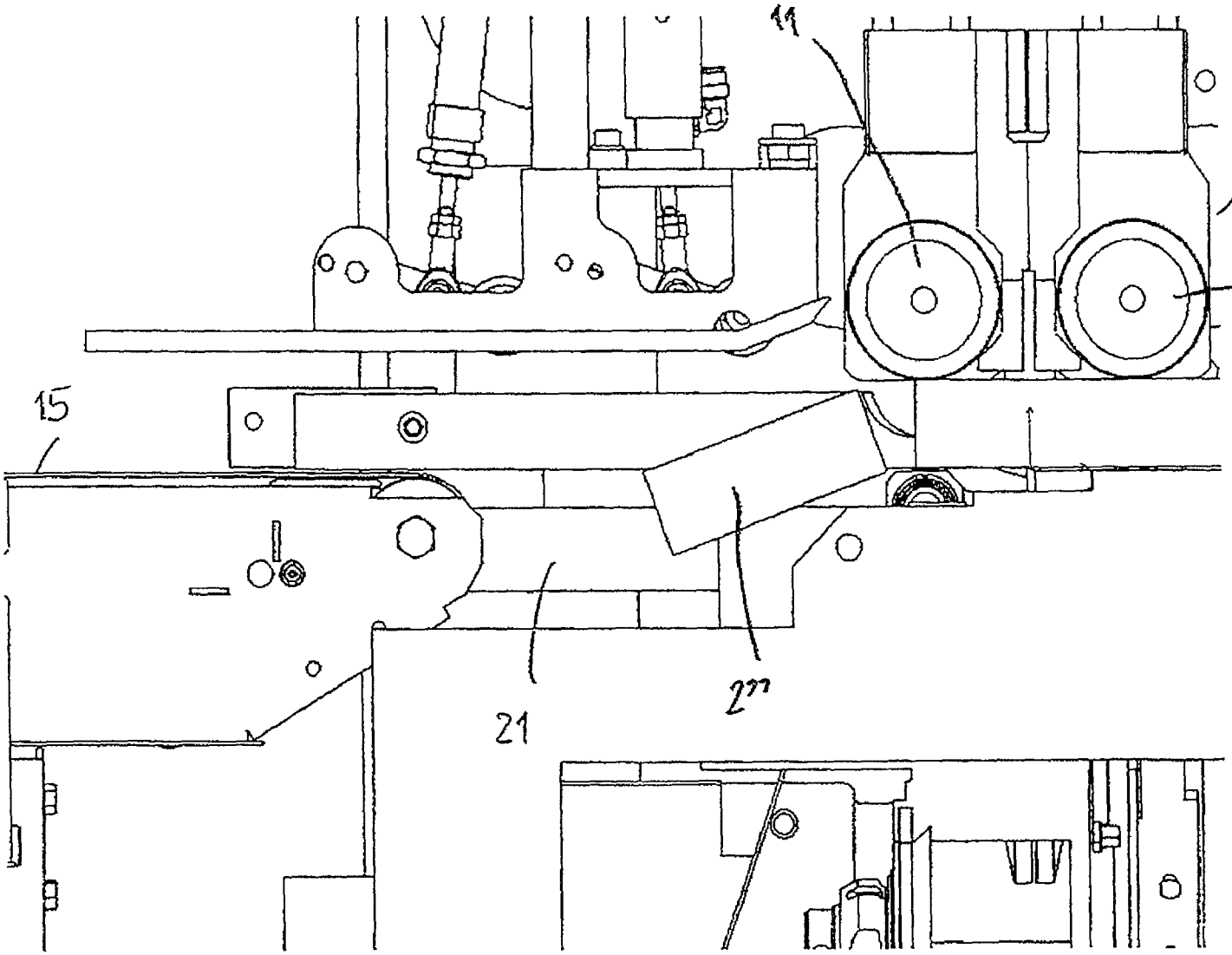
FIG. 4 is an illustration in accordance with FIG. 2 of the device according to the invention showing the waste part chute in a partially open position and a cut-off wood piece dropping into the waste part chute.
Figure 5:
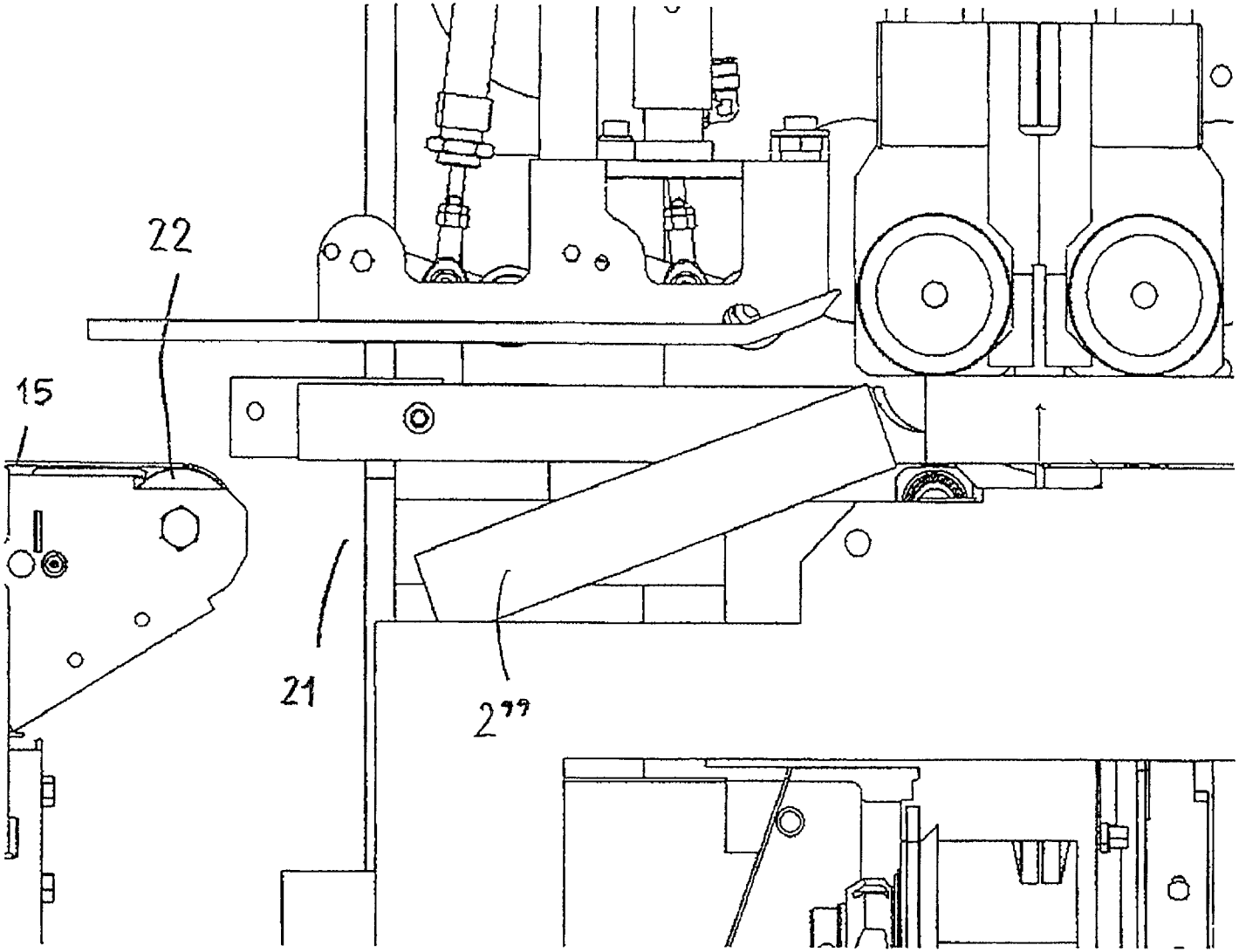
FIG. 5 is an illustration in accordance with FIG. 2 of the device according to the invention in which an elongate wood piece falls into the open waste part chute.

FIG. 4 shows the situation in which a waste part 2" having a flaw is to be sawed off by the saw 3. After it has first been positioned by means of the feed rollers 11, 12 relative to the saw blade and subsequently has been sawed off, it is transported away after the sawing process by the feed roller 11 that is now rotating again and drops into the open waste part chute 21. The sorting belt 15 has been retracted only so far that the waste part 2" can drop into the waste part chute 21.

When the waste part 2" is longer (FIG. 5), the corresponding deflection roller of the sorting belt 15 is retracted so far that the long waste part 2" can drop into the waste part chute 21.

Because the good parts 2' can be accelerated after the cut by means of the respective sorting rollers 17, 18, the waste part chute 21 can be opened very early without there being the risk that the workpiece part 2' can drop accidentally into the waste part chute 21.

In order for the waste parts 2" to drop reliably into the waste part chute 21, the actual dropping action is assisted by blowing air into the waste part chute 21. For this purpose, advantageously at least one blowing nozzle 23 (FIGS. 1 and 2) is provided at the support device 16 from which during the sorting process a quick blowing air pulse is ejected that assists the dropping action of the waste part 2". The blowing nozzle 23 is in the area between the feed roller 11 and the neighboring sorting roller 18. This waste part 2" can be sorted out at high speed because the good part 2' that has been transported before has been moved away quickly by the acceleration in accordance with the invention and, accordingly, the waste part chute 21 can be opened earlier. When the sawed-off waste part 2" is very short and the previously transported good part 2' is still held underneath the feed roller 11, there is only little time for the removal of the waste part 2" that has been cut off by the saw 3. In this case, the preceding good part 2' and the waste part 2" are pushed out simultaneously. The good part 2' is accelerated by means of the sorting roller 17, 18 so that, despite simultaneous advancing of good part and waste part and early opening of the waste part chute 21, the good part 2' can be transported away reliably by means of the sorting belt 15. The waste part chute 21 is opened only to such an extent as is required for removal of the waste part 2". Depending on the length of the good part 2" to be subsequently sawed off, the waste part chute 21 can remain open. This is the case, for example, when the good part 2' to be cut off subsequently has such a length that, despite the waste part chute 21 being open, its leading end in the transport direction can reach the sorting belt 15 while the trailing end is still engaged by the feed roller 11. As soon as the feed roller 11 is driven in rotation and the corresponding sorting roller 17, 18 is pressed against the good part 2', the sawed-off good part 2' is transported away across the open area of the waste part chute 21 in an accelerated fashion.

The sorting rollers 17, 18 are moved downwardly by the adjusting cylinders 19, 20 for each good part 2' and pressed against the good part 2'. Immediately thereafter, the adjusting cylinders 19, 20 return the sorting rollers 17, 18 so that the subsequent workpiece part 2' can reliably reach a position underneath the holding-down device 14.

It is also possible to provide only one sorting roller on the holding-down device 14 with which the corresponding good parts 2' can be pressed against the sorting belt 15. The use of two or several sorting rollers, positioned in the transport direction at a spacing behind one another, has the advantage that good parts 2' of different length can be accelerated within a very short period of time. The movement of the deflection rollers 22 of the sorting belt 15 is realized advantageously by means of a servo motor with which the sorting belt 15 or its corresponding deflection roller 22 can be positioned for opening and closing the waste part chute 21.

Instead of the waste part chute, it is possible to employ, for the purpose of sorting out the waste parts 2", different sorting devices, for example, slides that push the corresponding waste parts 2" transversely from the sorting belt 15. The corresponding slides can operate pneumatically, hydraulically, electrically or in a similar way. This sorting process can be done very quickly. In the above described way, the good parts 2' that have no flaws are transported by being accelerated away from the saw 3 after the sawing process on the sorting belt 15 by means of the sorting rollers 17, 18.

It is also possible to sort out the waste parts 2" along the further transport path of the workpiece parts.

It is possible to saw workpieces 2, to sort out waste parts, and to finally sort the good parts at high speed by means of the device.

The specification incorporates by reference the entire disclosure of German priority document 10 2006 039 702.9 having a filing date of 17 Aug. 2006.

While specific embodiments of the invention have been shown and described in detail to illustrate the inventive principles, it will be understood that the invention may be embodied otherwise without departing from such principles.

What is claimed is:

1. A device for sorting out waste parts of workpieces on saws, the device comprising:

a saw having at least one saw blade for cutting workpieces into workpiece parts;

at least one feed roller upstream of the saw in a transport direction of workpieces;

at least one feed roller downstream of the saw in the transport direction;

at least one transport device for the workpiece parts cut at the saw;

at least one acceleration roller arranged in the transport direction of the workpieces downstream of the saw above the at least one transport device;

wherein the at least one acceleration roller has a rest position above and spaced from a cut-off workpiece part and further has a contact position, wherein the at least one acceleration roller is moved downward from the rest position into the contact position so as to contact and press the cut-off workpiece part against the at least one transport device and the at least one acceleration roller is returned into the rest position after the cut-off workpiece has been entrained by the at least one transport device;

a drive acting on the at least one acceleration roller for moving the at least one acceleration roller into the contact position;

a support device supporting at least one holding-down device, wherein the drive is connected to the support device;

wherein the at least one holding down device has at least one opening through which opening the at least one acceleration roller is moved into the contact position.

2. The device according to claim 1, wherein the drive is an adjusting cylinder.

3. The device according to claim 1, further comprising a waste part chute for workpiece parts that are waste parts, wherein the at least one acceleration roller is arranged in an area above the waste part chute.

4. The device according to claim 3, wherein the at least one transport device is configured to close off the waste part chute as needed.

5. The device according to claim 3, further comprising at least one blowing nozzle arranged at the waste part chute.

6. The device according to claim 5, wherein the blowing nozzle is arranged between the at least one feed roller downstream of the saw and the at least one acceleration roller.

7. The device according to claim 1, wherein the at least one transport device has at least one endless circulating transport belt.

8. The device according to claim 7, wherein the at least one transport belt has at least one deflection roller and the at least one deflection roller is adjustable in the transport direction and opposite to the transport direction for opening and closing the waste part chute.

9. A method for sorting out waste parts of workpieces on saws with a device according to claim 1, the method comprising the steps of:

cutting workpieces into workpiece parts in a cutting area of a saw;

transporting by acceleration action the workpiece parts away from the cutting area by moving at least one acceleration roller by a drive, connected to a support device and acting on the at least one acceleration roller, from a rest position above and spaced from a cut-off workpiece part downwardly into a contact position through at least one opening of at least one holding down device supported on the support device to contact and press a cut-off workpiece part against at least one transport device and returning the at least one acceleration roller into the rest position after the cut-off workpiece has been entrained by the at least one transport device.

10. The method according to claim 9, wherein, in the step of transporting by acceleration action, a workpiece part that is a good part and a workpiece part that is a waste part are transported simultaneously away from the cutting area.

11. A device for sorting outwaste parts of workpieces on saws, the device comprising:

a saw having at least one saw blade for cutting workpieces into workpiece parts;

at least one feed roller upstream of the saw in a transport direction of workpieces;

at least one feed roller downstream of the saw in the transport direction;

at least one transport device for the workpiece parts cut at the saw;

at least one acceleration roller arranged in the transport direction of the workpieces downstream of the saw;

a waste part chute for workpiece parts that are waste parts, wherein the at least one acceleration roller is arranged in an area above the waste part chute;

at least one blowing nozzle arranged at the waste part chute;

a support device supporting at least one holding-down device for the workpiece parts, wherein the blowing nozzle is arranged on the support device.

* * * * *